US005316207A

United States Patent [19]

Ross et al.

[11] Patent Number: 5,316,207

[45] Date of Patent: May 31, 1994

[54] CONTAINER ADAPTED FOR STACKING

[75] Inventors: John A. Ross, Marietta, Ga.; Richard L. Schuster, Monroe, La.

[73] Assignee: Riverwood International Corporation, Atlanta, Ga.

[21] Appl. No.: 86,499

[22] Filed: Jul. 1, 1993

[51] Int. Cl.[5] ..... B65D 5/32

[52] U.S. Cl. ..... 229/23 R; 229/109; 229/120.011; 229/148; 229/150; 229/915

[58] Field of Search ..... 229/23 R, 109, 148–150, 229/120.011, 120.012, 915, 916, DIG. 11

[56] References Cited

U.S. PATENT DOCUMENTS

| | | | |
|---|---|---|---|
| 1,945,878 | 2/1934 | Breton | 229/916 |
| 3,015,431 | 1/1962 | Mulcoy | 229/915 |
| 3,142,378 | 7/1964 | Lengsfield, Jr. | 229/120.012 |
| 3,373,921 | 3/1968 | Crane | 229/23 R |
| 3,915,372 | 10/1975 | Crane | 229/23 R |
| 3,935,990 | 2/1976 | Crane | 229/23 R |
| 3,935,991 | 2/1976 | Crane | 229/23 R |
| 4,389,013 | 6/1983 | Hall et al. | 229/915 |
| 4,482,074 | 11/1984 | Lalley | 229/23 R |
| 4,645,122 | 2/1987 | Nederveld | 229/109 |
| 4,993,623 | 2/1991 | Kelly et al. | 229/23 R |
| 5,116,290 | 5/1992 | Ross | 229/23 R |

FOREIGN PATENT DOCUMENTS

| | | | |
|---|---|---|---|
| 510790 | 10/1992 | European Pat. Off. | 229/915 |

*Primary Examiner*—Gary E. Elkins

[57] ABSTRACT

A container formed by wrapping a slotted flexible sheet about rigid end panels having projections that extend through the slots. The projections include stacking projections which engage recesses in the end panels of adjacent stacked containers and support projections at the corners. The support projections engage each other when the containers are stacked to provide resistance to lateral loading. At least one end of the flexible sheet terminates in the top panel and engages a wedge-shaped projection on the end panels to lock that end of the sheet in place. The other end may be similarly locked in place or may overlap the first end and be held in place by a tab and slot arrangement. Alternatively, the other end portion of the sheet may include a lid which is held in place by mechanical tabs, while intermediate edges spaced from the end engage the wedge-shaped projections.

27 Claims, 4 Drawing Sheets

CONTAINER ADAPTED FOR STACKING

FIELD OF THE INVENTION

This invention relates to packaging and shipping containers which need not be fully enclosed but must be sturdy enough to protect the contents during handling and shipment. More particularly, the invention relates to a container of this type which is adapted to be stacked.

BACKGROUND OF THE INVENTION

Articles such as produce ideally should be packaged in containers which protect the contents against bruising or other damage during shipment and handling. They should also present an appealing appearance so that they can be used as retail packages after reaching their final destination, and should be economical as well.

One container used for this purpose is disclosed in U.S. Pat. No. 5,116,290 and comprises rigid end panels about which a flexible cover sheet is wrapped in order to form the bottom, side and top panels. The end panels include stacking projections on their upper or lower edges and stacking recesses on their opposite edge. When the containers are stacked, the projections from one container fit into the recesses of the next higher or lower container in an attempt to stabilize the stack. The flexible sheet is provided with slots for receiving the stacking projections and for receiving the corners of the end panels. In order to hold the end edges of the flexible sheet in place, the end panels are provided with angled slots into which the folded end edges of the sheet fit. Alternatively, in the embodiment in which the stacking projections extend upwardly, the edges of the sheet are held in place by a shoulder on the stacking projection which engages the end of the associated slot in the sheet.

Although the container disclosed in the patent includes certain desirable design features, it has been found to be lacking in some respects. Stacks of containers may at times be subjected to lateral loads which can be severe enough to cause the stacks to tip over despite the resistance of the stacking projections. In addition, the folded edges of the flexible cover sheet which fit into the angled slots in the end panels require extra amounts of sheet material which add to the cost of the construction. The alternative arrangement in which the sheet ends are held in place by the engagement of slots in the sheet with shoulders on the stacking projections is also not as satisfactory as desired due to the fact that the edges of the sheets are not positively secured. Forces tending to move the slots out of locking alignment with the stacking projections can cause the edges of the top sheet to be pulled away from their original position. Further, the shipping container is often too large to be used as a container for retail sales.

The main object of this invention is to provide a container which makes use of the basic design concept described above, but improves the container in the areas discussed.

BRIEF SUMMARY OF THE INVENTION

The improved container of the invention is based on the type of container discussed above which comprises top, bottom and side panel sections extending between two spaced, substantially parallel, relatively rigid end panels. Each end panel includes a plurality of stacking projections extending from either the upper or lower edge and a plurality of recesses in the edge opposite the projections for receiving the stacking projections of a similar adjacent stacked container.

The top, bottom and side panel sections comprise portions of a relatively flexible sheet folded about the end panels in a manner such that the top panel sections include the opposite end edges of the sheet. The sheet includes slots through which the stacking projections and the corners of the end panels extend, as well as slots opposite the recesses for receiving the stacking projections of a similar adjacent stacked container. In addition, means are provided for holding the opposite end edges of the top panel sections in place.

In one aspect of the invention each end panel includes shoulders in the upper corner areas and feet in the lower corner areas, with the feet and shoulders having aligned support surfaces such that the support surfaces of the feet of a container contact the support surfaces of the shoulders of a similar adjacent stacked container. This provides additional stability which guards against the possibility of a stack of containers tipping and falling due to lateral loads.

In another aspect of the invention at least one outwardly tapered locking surface extends upwardly from the upper edges of the end panels and is contacted by an end edge of the sheet to lock that end of the sheet in place. In one embodiment the other end of the sheet is also locked into place by a similar arrangement, so that the ends of the sheet engage opposite sides of a wedge-shaped projection. In another embodiment the other end of the sheet overlaps the first end and is locked in place by mechanical locking means. The overlapping sheet of the top panel sections in the latter arrangement may include a hinged lid, in which case the lid is held in place by mechanical locking means while edges of the sheet adjacent the lid engage the tapered surface of a wedge-shaped projection.

In another aspect of the invention, the top, bottom and side panel sections of the container include at least one transversely extending weakened area which permits the container to be separated into a plurality of smaller container units. Intermediate panels similar in size and shape to the end panels are located on either side of the weakened area, and the top, bottom and side panel sections include slots for receiving the stacking projections and corner areas of the intermediate panels.

In a preferred embodiment the stacking recesses are in the lower edges of the end panels and the stacking projections extend up from the upper edges of the end panels. In such an arrangement the stacking projections extend a greater distance than the support surfaces of the shoulders from the upper edge of an end panel.

The container is easily fabricated and results in an economical, strong package which can be stacked without risk of toppling caused by normally encountered lateral loads. The top panel ends are readily locked in place by a positive locking means, and the package can be broken down into smaller units as required for retail sales.

These and other features and aspects of the invention, as well as its various benefits, are made more clear in the detailed description of the preferred embodiments which follows.

DETAILED DESCRIPTION OF THE PREFERRED EMBODIMENTS

Figure 1:
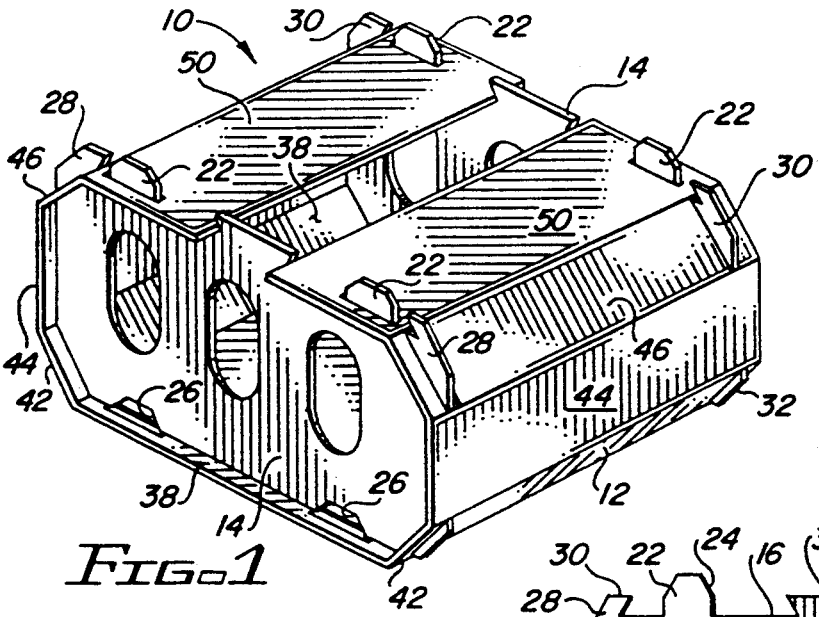
FIG. 1 is a pictorial view of the container of the invention.

Referring to FIG. 1, a container 10 of the type embodying the concepts of the invention is comprised of a flexible cover sheet 12 and rigid end panels 14. The flexible cover sheet may be formed of paperboard of a thickness normally used in the manufacture of carriers from foldable paperboard blanks, while the end panels may be formed of thick paperboard, pressed board or any other readily available economical rigid material.

Figure 3:
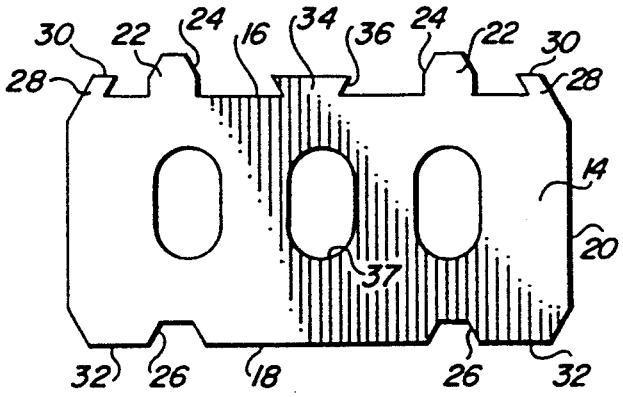
FIG. 3 is a side elevation of an end panel element used in forming the container.

The end panels are shown in FIGS. 1 and 3 as being of generally rectangular shape, having upper and lower edges 16 and 18, respectively, and side edges 20. Projecting from the upper edge 16 are two spaced stacking projections 22 having inwardly tapered side edges 24. Two similarly shaped stacking recesses 26 are formed in the lower edge 18 so as to be aligned with the projections 22. Each upper corner area of the end panel includes an upwardly projecting shoulder 28, the upper surface of which comprises a shoulder support surface 30, While the lower surface 32 of each of the lower corner areas comprises a foot support surface. Extending from the central portion of the upper edge 16 is a wedge-shaped projection 34 which has outwardly tapered side edges 36. Openings 37 in the end panels provide hand grips for lifting the container and also allow air to flow into the container to keep packaged produce in fresh condition.

Figure 2A:
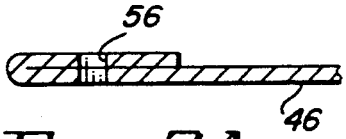
FIG. 2A is a transverse sectional view taken on line 2A—2A of FIG. 2.
Figure 2:
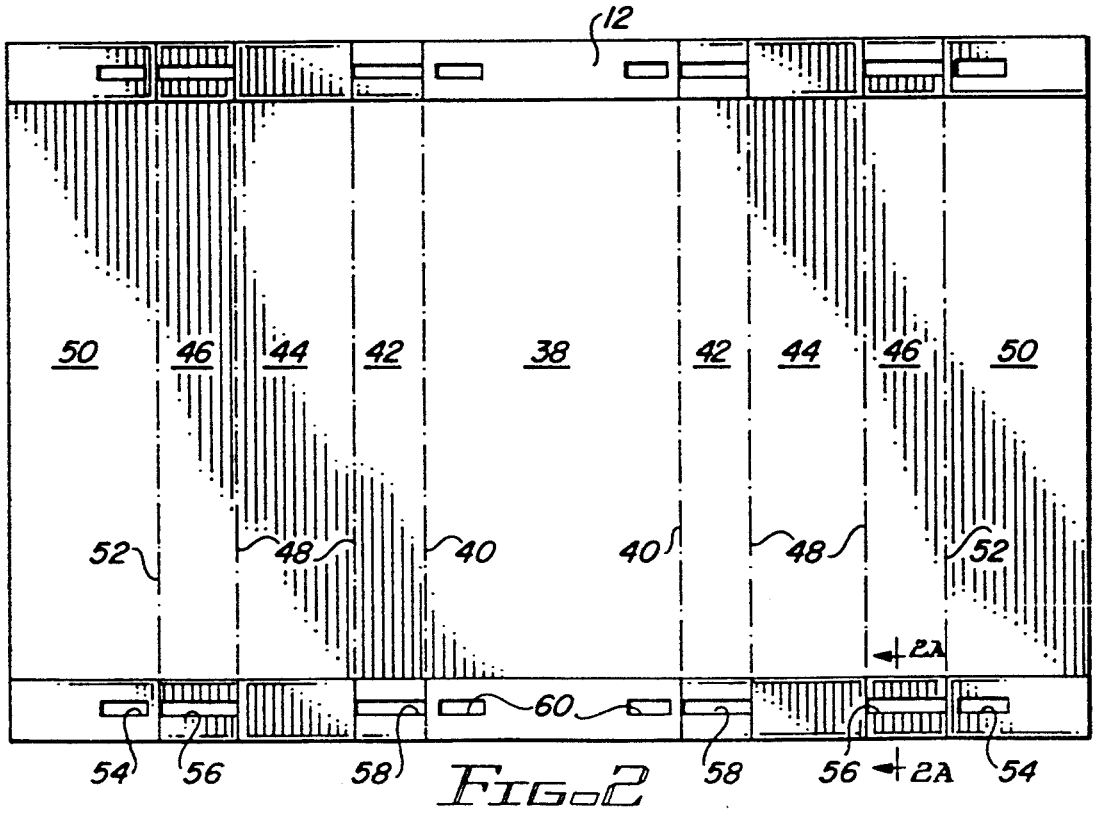
FIG. 2 is a plan view of the blank used in forming the top, bottom and side panels of the container.

The blank used to form the cover sheet 12 of the container of FIG. 1 is shown in FIG. 2 as being rectangular in shape. A series of parallel fold lines allows the sheet to be folded about two spaced parallel end panels 14 to form the panels of the container. Thus, the bottom panel section 38 is connected by fold lines 40 to the lower sloped side panel section 42 and the main side panel sections 44 are connected to the lower and upper sloped side panel sections 42 and 46, respectively, by fold lines 48. The top panel sections 50 are connected to the upper sloped side panel sections 46 by fold lines 52.

The edge portions of the sheet which are parallel to the end panels are provided with slots for receiving the projections and corner areas of the end panels. Thus, slots 54 receive the stacking projections 22, slots 56 receive the upper corners or shoulders 28 and slots 58 receive the lower corners of the end panels. In addition, slots 60 are provided to allow passage of the stacking projections of the next lower container in a stacked arrangement. If desired, the edge portions adapted to be connected to the end panels may be reinforced in order to strengthen the slot areas. For example, the edge portions of the sheet illustrated in FIG. 2 have been shown as being folded over to form an area of double thickness. As shown in more detail in FIG. 2A, the slot 56, which is also illustrative of the arrangement of the other slots 54, 58 and 60, extends through both plies of the double thickness area.

To fabricate the container of FIG. 1 from the blank and end panels of FIGS. 2 and 3, it is merely necessary to position two end panels so that their recesses 26 are aligned with the slots 60 of the blank and to then fold the blank about the edges of the end panels so that the corner areas and stacking projections of the end panels penetrate their associated slots in the blank. The folds 48 of the sheet of the blank produce the sloped side panel sections 42 and 46 of the container, causing the upper and lower corner areas of the end panels to protrude through the slots 56 and 58, respectively. The shoulder surfaces 30 of the upper corner areas and the feet surfaces 32 of the lower corner areas are thereby exposed.

Figure 4:
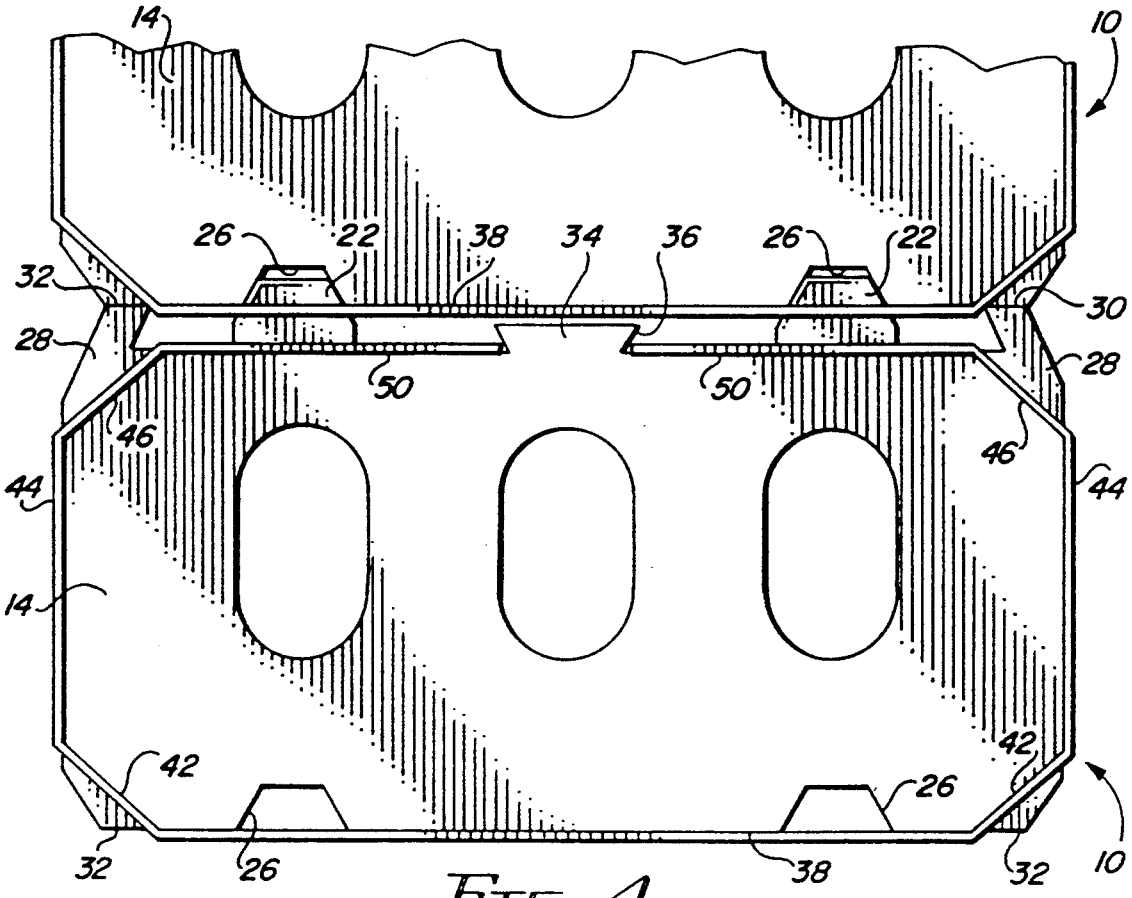
FIG. 4 is an enlarged end view of a container shown in stacked relationship with an adjacent similar container.

Referring to FIG. 4, two containers 10 are illustrated in stacked condition. The stacking projections 22 of the lower container extend through the slots 54 in the top panel 50 of the container, through the slots 60 in the bottom panel of the upper container and into the stacking recesses 26 of the upper container. The tapered edges of the projections 22 engage the similarly shaped sides of the recesses 26 to provide basic support for the upper container. As previously mentioned, a stack of containers can be subjected to lateral loads during storage and shipping which can topple the stack despite this support arrangement. To resist lateral loading forces the containers are further supported in the stack by contact between the bottom surface 32 of the feet of the upper container with the upper surface 30 of the ears 28 of the lower container. This additional support stabilizes the containers in the stack to overcome the tendency to tip over under substantial lateral loading. The support surfaces 30 and 32 are illustrated as being horizontally disposed in the stack. Although this is the preferred arrangement, it will be appreciated that these surfaces could be at an angle to the horizontal as long as they are in mating engagement in a stack.

Still referring to FIG. 4, the spaced ends of the top panel portions 50 are held in place by engagement of the end edges of the top panel portions with the tapered sides 36 of the wedge-shaped projection 34. When folding the cover sheet about the end panels, it is a simple procedure to push the end edges of the top panel portions down against the sides 36 as the stacking projections 22 are being inserted through the slots 54. This snaps the ends of the top panel portions into place at the base of the wedge-shaped projection 34, and the outwardly tapered sides 36 prevent subsequent upward movement of the top panel portions. Since outward movement of the top panel portions is prevented by the stacking projections 22, the top panel portions are effectively locked in place without the need for extra folds as in the prior art discussed above. Although the dimensions of the wedge-shaped projection and the spacing between the top panel portions may vary as desired, it is clear from FIG. 4 that the height of the wedge-shaped projection must be at least slightly greater than the thickness of the top panel portions in order to prevent upward movement by the top panel portions. The projection 34 cannot, however, extend up higher than the shoulder surfaces 32. Otherwise, the wedge-shaped projection 34 would prevent the feet of the next higher container from contacting the shoulder surfaces of the lower container.

Figure 5:
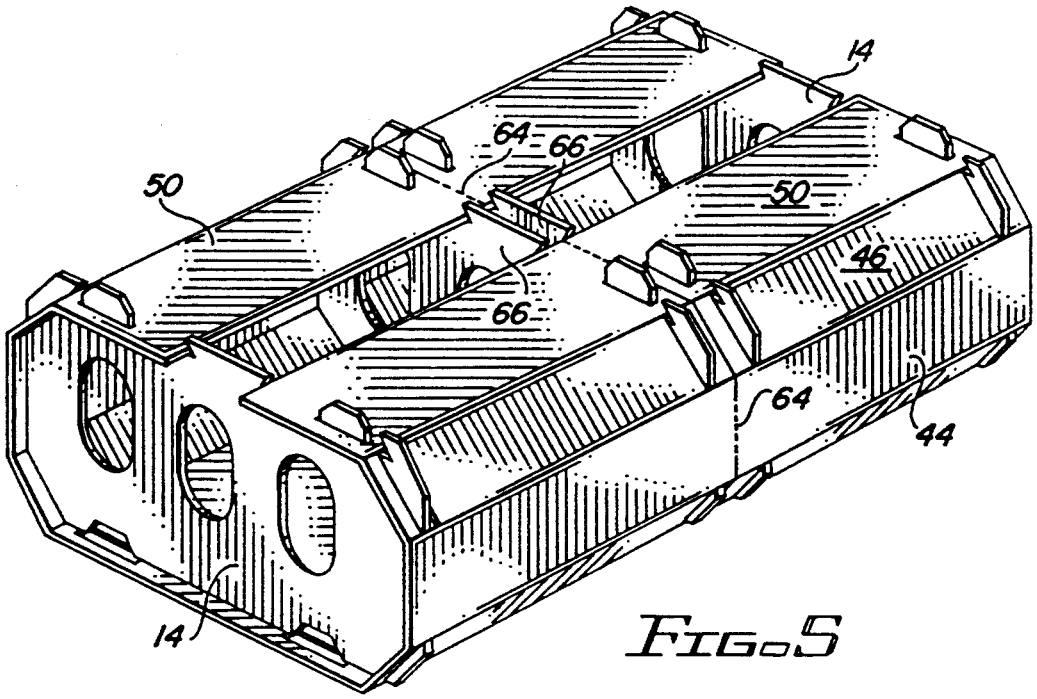
FIG. 5 is a pictorial view similar to that of FIG. 1, but showing a modified container design.

Referring now to FIG. 5, a container 62 formed in accordance with the preceding description has been modified to allow it to be broken down into two smaller units. The container is similar to the container of FIG. 1 except that an area of weakness 64, enabling the container to be separated, extends about the periphery of the container. The area of weakness may take any desired form, as for example a line of spaced slits, as long as the area can readily be broken or torn apart. On either side of the area or line 64 are intermediate panels 66 which are similar to the end panels 14 and whose projections and corner areas are received by slots in the cover sheet similar to the slots 54, 56, 58 and 60. When the container is broken down into two separate units, each resulting smaller container will have end panels consisting of an original end panel 14 and an intermediate panel 66. The design need not be limited to a single tear line if the strength of the container and the weight of its contents permit still larger size containers to be used. In such a case, additional areas of weakness, along with additional associated intermediate panels, may be provided.

Figure 6:
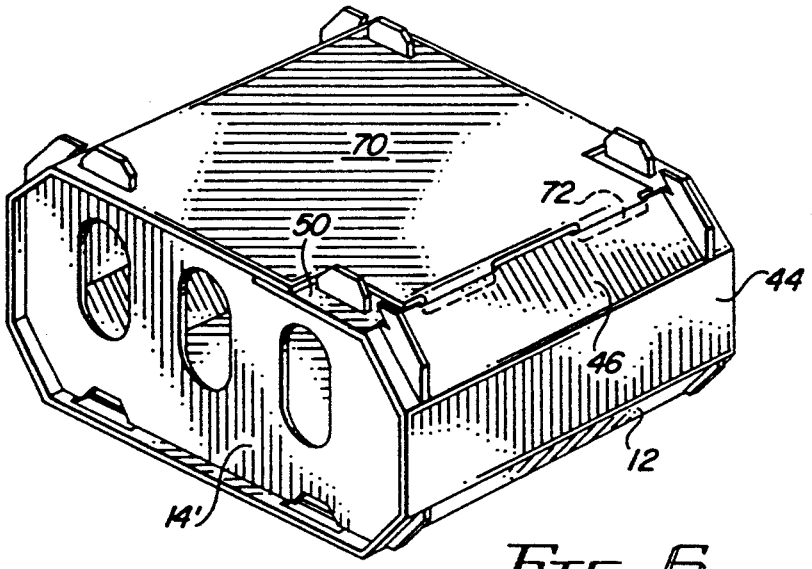
FIG. 6 is a pictorial view similar to that of FIG. 1, but showing another modified container design.
Figure 7:
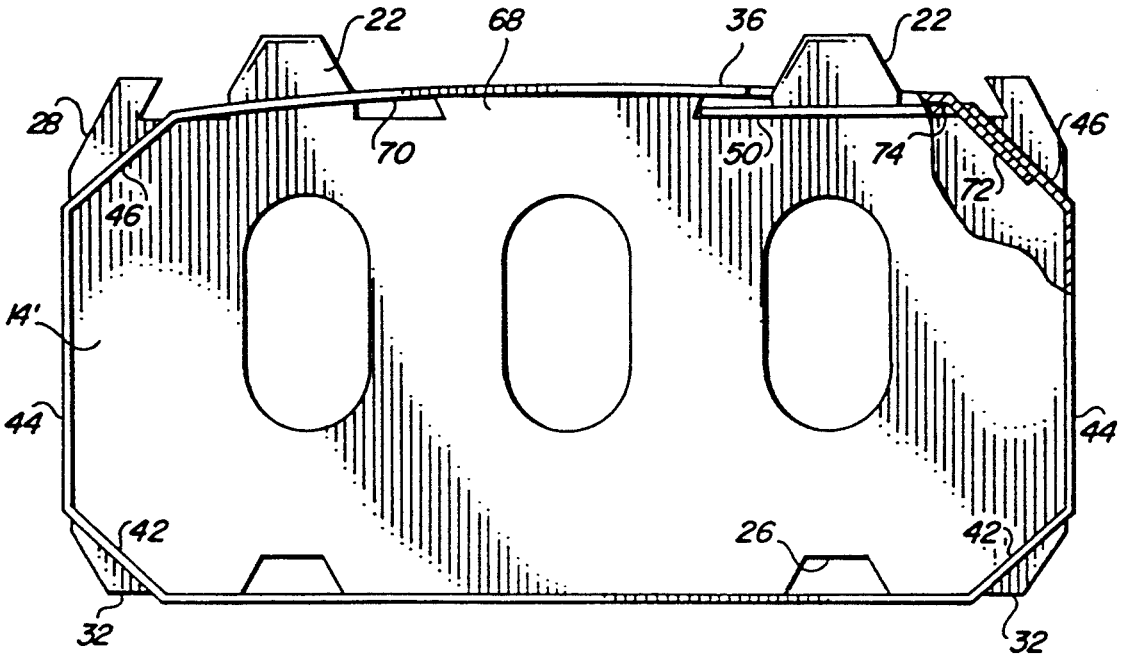
FIG. 7 is an enlarged end view of the container of FIG. 6, shown partially in section.

Another form of the container of the invention is shown in FIGS. 6 and 7, wherein similar reference numerals have been used to indicate similar elements of the container. This modified container is similar to the container of FIG. 1 except for differences in the top panel and upper portions of the end panels. Instead of two spaced top panel sections, this container has one short top panel section 50 which engages the tapered edge 36 of projections 68 in end panels 14' and a long section 70 which rests on the upper edge of the end panel projections. The long top panel section overlaps the short top panel section 50, extending to the opposite sloped upper end panel section 46. Locking tabs 72, foldably connected to the edge of the top panel section 70, extend through slots 74 at the juncture between the sections 50 and 46 and lie beneath the upper sloped panel section 46. This holds the panel section 70 in place even if the top panel section 50 were somehow disengaged from the tapered sides of the end panel wedge projections due to impact forces experienced during handling and shipping.

Although only one of the tapered edges 36 of the end panel projection 68 is in contact with the end of the panel section 50, the projection is preferably provided with two tapered edges as in the first embodiment so as to be capable of use at either end of the container. The projection preferably is longer than in the first embodiment to maximize the area of support for the top panel section 70. Although the top panel section 70 is shown as a solid sheet, it may be provided with openings to better permit the flow of air through the container. Also, although not shown, the container may be provided with tear strips as described above.

Figure 8:
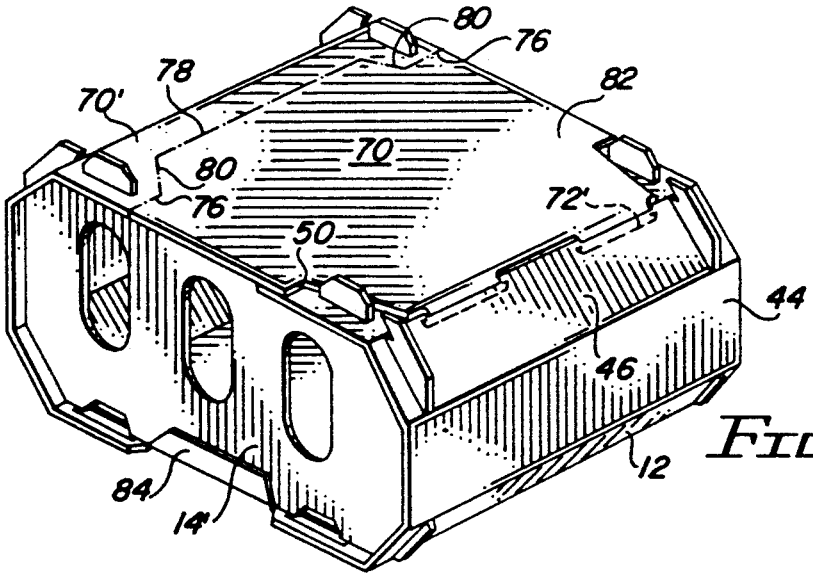
FIG. 8 is a pictorial view showing another modified container design.

Another modification of the invention is illustrated in FIG. 8. This arrangement is generally similar to the design of FIG. 6 in that the top panel is made up of a short top panel section 50' and an overlapping long top panel section 70'. As in the embodiment of FIG. 6, the long top panel section 70' is provided with locking tabs 72' which fit into slots 74' at the juncture between the short top panel section 50' and the adjacent panel section 46. The top panel section 70' in this embodiment, however, includes slits 76 extending in from the end edges of the top panel section for a short distance and a fold line 78 spaced a short distance from the adjacent side panel. Diagonal slits 80 connect the ends of the slits 76 to the ends of the fold line 78. The portion of the top panel section 70' extending outwardly from the fold line 78 thus comprises a lid 82 which is hinged at the fold line 76.

Figure 9:
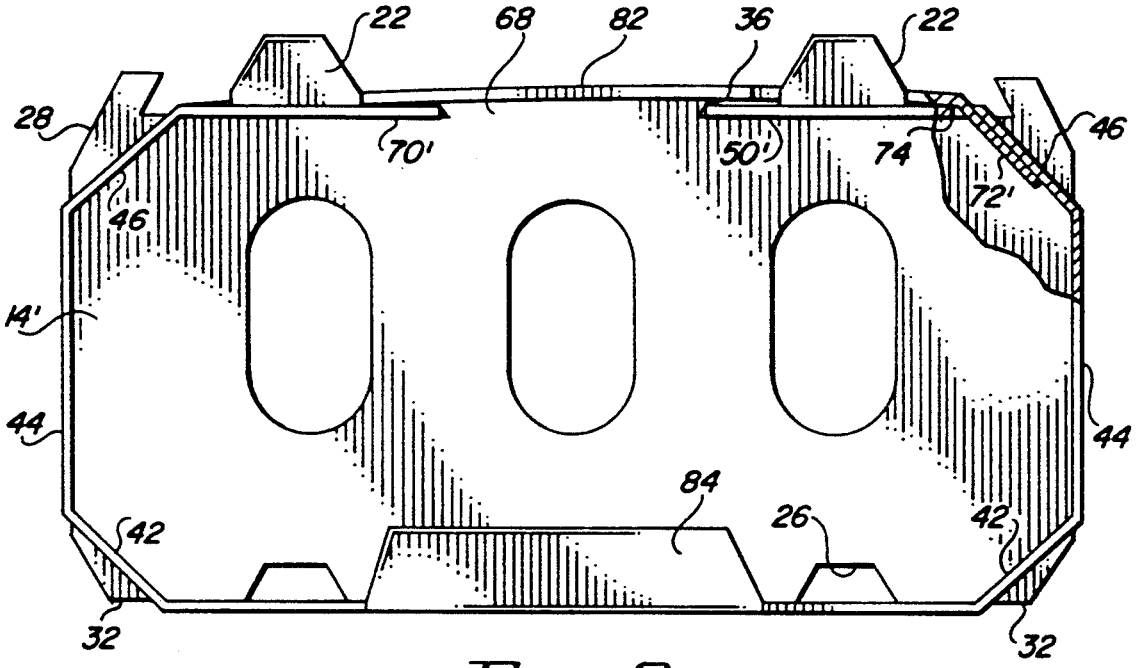
FIG. 9 is an enlarged end view of the container of FIG. 8, shown partially in section.

As illustrated in FIG. 9 as well as FIG. 8, when the container is closed, the edges of the top panel section 70' corresponding to the slits 76 engage the tapered edges 36 of the wedge-shaped end panel projections 68 and the edge of the short panel section 50' engages the opposite tapered edges of the projections. The end edge portions of the lid are supported on the upper edges of the wedge-shaped projections 68 and the locking tabs 72' extend through the slots 74'. To gain access to the interior of the container it is merely necessary to pull the locking tabs from their slots and pivot the lid up about its fold line 78. This is simpler than having to peel back the long top panel section over the projections 22 and 28, as in the embodiment of FIGS. 6 and 7. It also provides a more secure container since the edges of the top panel sections engaging the wedge-shaped projections can remain locked in place at all times. Although shown as the same size as the container of FIGS. 6 and 7, the container of this embodiment may be made considerably longer by increasing the width of the projections 68 to accommodate a longer top panel.

Figure 10:
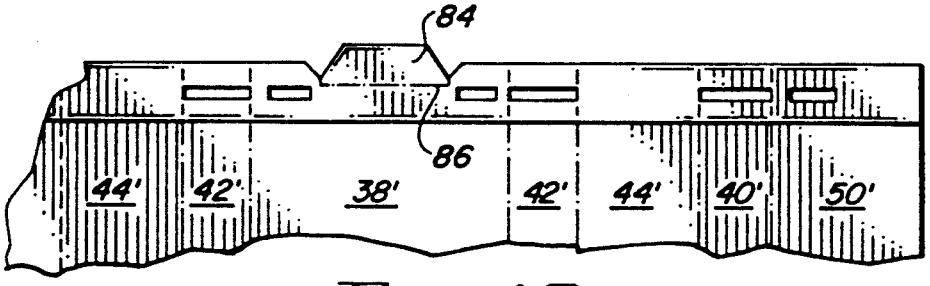
FIG. 10 is a partial plan view of the blank used in forming the container of FIG. 8.

An added feature of the embodiment shown in FIGS. 8 and 9 is the provision of a flap 84 along the edges of the flexible sheet lying between the recesses 26 of the end panels 14'As shown in FIG. 10, the flap is connected to the sheet by a fold line 86 between the spaced edges of the two-ply margin of the sheet. By gluing the flaps to the end panels, the end panels and the flexible sheet can be handled and shipped prior to fabrication as a unit, with the end panels being folded in to lie flat against the bottom panel section of the sheet. Fabrication of the container is made easier due to the end panels being held in place by their attachment to the flexible sheet while the sheet is wrapped and folded into place.

It can now be appreciated that the invention provides a container which overcomes the tendency of prior art stacked containers to topple when subjected to increased lateral loading and which firmly locks the end edges of the top panel segments in place without danger of the segments opening and without requiring additional cover sheet material to accomplish this result. Although the illustrations in the drawing of the various arrangements for locking the end portions of the flexible sheet in place show the support shoulders and feet of the end panels, these locking arrangements may be utilized in containers which do not include such shoulders and feet.

It should be obvious that although preferred embodiments of the invention have been described, changes to certain details of the embodiments can be made without departing from the spirit and scope of the invention defined in the appended claims.

What is claimed is:

1. A container, comprising:

two spaced, substantially parallel, relatively rigid end panels;

each of the end panels having upper and lower edges, side edges and upper and lower corner areas;

top, bottom and side panel sections extending between the end panels;

each of the end panels including a plurality of stacking projections extending from either the upper or lower edge thereof and a plurality of recesses in the upper or lower edge opposite the projections, whereby the recesses are capable of receiving stacking projections of a similar adjacent stacked container;

each of the end panels further including shoulders in the upper corner areas and feet in the lower corner areas, the feet and shoulders having aligned support surfaces, whereby the support surfaces of the feet are capable of contacting shoulder support surfaces of a similar adjacent stacked container;

the top, bottom and side panel sections comprising portions of a relatively flexible sheet folded about the end panels, the sheet including slots through which the plurality of stacking projections and the shoulders and feet of the end panels extend, the sheet also including slots opposite the plurality of recesses, whereby the slots are capable of receiving stacking projections of a similar adjacent stacked container;

the top panel sections including end portions of the sheet; and means for holding the end portions of the sheet in place.

2. A container according to claim 1, wherein the support surfaces of the feet and shoulders are substantially horizontal when the container is in stacked condition.

3. A container according to claim 1, wherein the side panel sections include upper and lower sloped portions connected to the top and bottom panel sections, respectively.

4. A container according to claim 3, wherein the shoulders and feet extend through slots in the sloped portions of the side panel sections.

5. A container according to claim 1, wherein the plurality of stacking projections extend up from the upper edges of the end panels, and the plurality of recesses are in the lower edges thereof.

6. A container according to claim 5, wherein the plurality of stacking projections extend up from the upper edges of the end panels a greater distance than the support surfaces of the shoulders.

7. A container according to claim 1, wherein the means for holding the end portions of the sheet in place includes an outwardly tapered surface extending upwardly from the upper edge of each of the end panels above an adjacent end portion of the sheet, the adjacent end portion of the sheet engaging the tapered surface.

8. A container according to claim 7, including a second outwardly tapered surface facing oppositely of the first mentioned tapered surface, the end portion of the sheet opposite said adjacent end portion engaging the second tapered surface and being spaced from said adjacent end portion of the sheet.

9. A container according to claim 7, wherein each of the outwardly tapered surfaces is spaced from the upper edge of its associated end panel a distance no greater than the distance that the support surfaces of the shoulders are spaced from said upper edge.

10. A container according to claim 7, wherein the means for holding the end portions of the flexible sheet in place includes at least one locking tab extending from the end portion of the sheet opposite said adjacent end portion through a locking slot in the sheet, said opposite end portion of the sheet overlapping said adjacent end portion.

11. A container according to claim 10, wherein the top and side panel sections meet at a juncture, the locking slot being located substantially at said juncture.

12. A container according to claim 7, including second outwardly tapered surfaces facing oppositely of the first mentioned tapered surface, the end portion of the sheet opposite said adjacent end portion including edges engaging the second tapered surfaces and being spaced from the end of said adjacent end portion of the sheet, a lid hingedly connected to the other end portion of the sheet, the lid having at least one locking tab extending through a slot in said adjacent end portion.

13. A container according to claim 12, wherein the edges of the sheet engaging the second tapered surfaces are formed by portions of slits in the end portion of the sheet opposite said adjacent end portion, the slits extending in to the hinged connection of the lid.

14. A container according to claim 1, wherein the top, bottom and side panel sections of the container include at least one transversely extending weakened area permitting the container to be separated into a plurality of smaller container units, the container including intermediate panels having stacking projections, shoulders and feet similar in size and shape to those of the end panels, the intermediate panels being located on either side of the weakened area, and the top, bottom and side panel sections including slots for receiving the plurality of stacking projections and the shoulders and feet of the intermediate panels.

15. A container comprising:

two spaced, substantially parallel, relatively rigid end panels;

each of the end panels having upper and lower edges, side edges and upper and lower corner areas;

top, bottom and side panel sections extending between the end panels;

each of the end panels including a plurality of stacking projections extending from either the upper or lower edge thereof and a plurality of recesses in the upper or lower edge opposite the projections, whereby the recesses are capable of receiving stacking projections of a similar adjacent stacked container;

the top, bottom and side panel sections comprising portions of a relatively flexible sheet folded about the end panels, the sheet including slots through which the plurality of stacking projections and the upper and lower corner areas of the end panels extend, the sheet also including slots opposite the plurality of recesses, whereby the slots are capable of receiving stacking projections of a similar adjacent stacked container;

the top panel sections including opposite end edges of the sheet; and the bottom panel section including flaps adhered to the end panels.

16. A container, comprising:

two spaced, substantially parallel, relatively rigid end panels;

each of the end panels having upper and lower edges, side edges and upper and lower corner areas;

top, bottom and side panel sections extending between the end panels;

each of the end panels including a plurality of stacking projections extending from either the upper or lower edge thereof and a plurality of recesses in the upper or lower edge opposite the projections, whereby the recesses are capable of receiving stacking projections of a similar adjacent stacked container;

the top, bottom and side panel sections comprising portions of a relatively flexible sheet folded about the end panels, the sheet including slots through which the plurality of stacking projections and the upper and lower corner areas of the end panels extend, the sheet also including slots opposite the plurality of recesses, whereby the slots are capable of receiving stacking projections of a similar adjacent stacked container;

the top panel sections including spaced opposite end edges of the sheet; and outwardly tapered locking surfaces extending upwardly from the upper edges of the end panels above the opposite end edges of the sheet, the opposite end edges of the sheet contacting the outwardly tapered locking surfaces to lock the top panel in place.

17. A container according to claim 16, wherein the outwardly tapered locking surfaces comprise opposite sides of a wedge-shaped projection, the opposite end edges of the sheet being spaced apart a distance causing the end edges to contact the sides of the wedge-shaped projection.

18. A container according to claim 16, wherein the top, bottom and side panel sections of the container include at least one transversely extending weakened area permitting the container to be separated into a plurality of smaller container units, the container including intermediate panels having stacking projections, shoulders and feet similar in size and shape to those of the end panels, the intermediate panels being located on either side of the weakened area, and the top, bottom and side panel sections including slots for receiving the plurality of stacking projections and the upper and lower corner areas of the intermediate panels.

19. A container, comprising:

two spaced, substantially parallel, relatively rigid end panels;

each of the end panels having upper and lower edges, side edges and upper and lower corner areas;

top, bottom and side panel sections extending between the end panels;

each of the end panels including a plurality of stacking projections extending from either the upper or lower edge thereof and a plurality of recesses in the upper or lower edge opposite the projections, whereby the recesses are capable of receiving the stacking projections of a similar adjacent stacked container;

the top, bottom and side panel sections comprising portions of a relatively flexible sheet folded about the end panels, the sheet including slots through which the plurality of stacking projections and the upper and lower corner areas of the end panels extend, the sheet also including slots opposite the recesses, whereby the slots are capable of receiving stacking projections of a similar adjacent stacked container;

the top panel sections being comprised of overlapping end portions of the sheet, the underlying end portion having an end edge in engagement with an outwardly tapered locking surface extending upwardly from the upper edge of each of the end panels above the end edge of the sheet, the overlying end portion being at least partially mechanically locked in place.

20. A container according to claim 19, wherein the overlying end portion includes at least one locking tab extending through a slot in the underlying portion of the sheet.

21. A container according to claim 19, including second outwardly tapered surfaces extending upwardly from the upper edges of the end panels and facing oppositely of the first mentioned tapered surface, the overlying end portion of the sheet including edges engaging the second tapered surfaces, the overlying end portions of the sheet extending past the tapered surfaces and including a lid hingedly connected to the other end portion of the sheet, the lid having at least one locking tab extending through a slot in said one end portion.

22. A container according to claim 21, wherein the edges of the other end portion of the sheet which engage the second tapered surfaces are formed by portions of slits in the other end portion of the sheet, the slits extending in to the hinged connection of the lid.

23. A container according to claim 19, wherein the top, bottom and side panel sections of the container include at least one transversely extending weakened area permitting the container to be separated into a plurality of smaller container units, the container including intermediate panels having stacking projections, shoulders and feet similar in size and shape to those of the end panels, the intermediate panels being located on either side of the weakened area, and the top, bottom and side panel sections including slots for receiving the stacking projections and the upper and lower corner areas of the intermediate panels.

24. A blank for forming a container, comprising:

a substantially rectangular flexible sheet having opposite ends and opposite edge portions and a central section adapted to be the bottom panel of the container;

flaps connected to the edge portions of the central section of the sheet, each of the flaps being adhered to a lower edge portion of a rigid end panel;

each of the end panels having upper and lower edges, side edges and upper and lower corner areas;

each of the end panels including a plurality of stacking projections extending from either the upper or lower edge thereof and a plurality of recesses in the upper or lower edge opposite the projections, whereby the recesses are capable of receiving stacking projections of a similar adjacent stacked container;

the flexible sheet adapted to be folded about the edges of the end panels, the sheet containing slots in the edge portions thereof through which the plurality of stacking projections and the upper and lower corner areas of the end panels extend in the container, the sheet also including slots adapted to be opposite the plurality of recesses in the end panels of the container, whereby the slots are capable of receiving stacking projections of a similar adjacent stacked container;

and means adapted to hold the opposite ends of the sheet in place in the container.

25. A blank according to claim 24, wherein the means adapted to hold the opposite ends of the sheet in place includes an outwardly tapered locking surface extending upwardly from the upper edge of the end panels, at least one of the ends of the flexible sheet adapted to engage the tapered surface to be held in place thereby.

26. A blank according to claim 25, wherein the means adapted to hold the opposite ends of the sheet in place includes a second outwardly tapered surface facing oppositely of the first mentioned tapered surface, the other of the ends of the sheet adapted to engage the second tapered surface to be held in place thereby.

27. A blank according to claim 25, wherein one of the ends of the sheet is adapted to engage the tapered surface and edges of the sheet spaced from the opposite end of the sheet are adapted to engage opposite tapered surfaces on the end panels to lock the flexible sheet in place.

* * * * *